US008252372B2

(12) United States Patent
Terada et al.

(10) Patent No.: US 8,252,372 B2
(45) Date of Patent: Aug. 28, 2012

(54) METHOD OF FORMING SPRAYED FILM ON THE INNER SURFACE OF A BORE

(75) Inventors: Daisuke Terada, Yokohama (JP); Kiyohisa Suzuki, Ebina (JP); Eiji Shiotani, Kawasaki (JP); Akira Shimizu, Yokohama (JP); Akiharu Tashiro, Yokohama (JP); Kei Fujii, Warabi (JP)

(73) Assignee: Nissan Motor Co. Ltd., Yokohama-shi, Kanagawa (JP)

( * ) Notice: Subject to any disclaimer, the term of this patent is extended or adjusted under 35 U.S.C. 154(b) by 928 days.

(21) Appl. No.: 12/255,756

(22) Filed: Oct. 22, 2008

(65) Prior Publication Data

US 2009/0104348 A1 Apr. 23, 2009

(30) Foreign Application Priority Data

Oct. 23, 2007 (JP) ..... 2007-274913
Oct. 23, 2007 (JP) ..... 2007-274916
Jul. 1, 2008 (JP) ..... 2008-172160

(51) Int. Cl.
*B05D 7/22* (2006.01)
*B05D 1/08* (2006.01)

(52) U.S. Cl. ..... 427/233; 427/236; 427/446

(58) Field of Classification Search ..... 427/230, 427/233, 234, 236, 239, 446–456
See application file for complete search history.

(56) References Cited

U.S. PATENT DOCUMENTS

| | | | | |
|---|---|---|---|---|
| 4,201,341 | A | 5/1980 | Huhne et al. | |
| 5,922,412 | A * | 7/1999 | Baughman et al. | 427/449 |
| 5,958,520 | A * | 9/1999 | Cook et al. | 427/446 |

FOREIGN PATENT DOCUMENTS

| | | | |
|---|---|---|---|
| DE | 198 23 398 | A1 | 12/1999 |
| DE | 198 40 051 | A1 | 3/2000 |
| EP | 0 839 924 | A1 | 5/1998 |
| EP | 1 714 704 | A1 | 10/2006 |
| EP | 1 770 185 | A2 | 4/2007 |
| JP | 2005-171274 | A | 6/2005 |
| JP | 2006-291336 | | 10/2006 |
| WO | 91/12183 | A1 | 8/1991 |

* cited by examiner

*Primary Examiner* — William Phillip Fletcher, III
(74) *Attorney, Agent, or Firm* — Young Basile

(57) ABSTRACT

A sprayed film forming method and apparatus in which the thickness of the sprayed film in a predetermined region is increased so as to unify the entire thickness. A sprayed film is formed at a cylinder bore inner surface while a spraying gun is moved in an axial direction during rotation inside the bore. Air inside the bore is sucked out to prevent foreign material from being caught in the sprayed film. The flow rate inside the bore tends to become higher at an axial end on a suction side, resulting in a thinned region. The supply speed of a wire serving as a spraying material to the spraying gun or the number of sprays in this region is higher than those at other portions. The thickness at the axial end of the bore is made equal while suppressing an increase in working time and spraying material used.

12 Claims, 3 Drawing Sheets

METHOD OF FORMING SPRAYED FILM ON THE INNER SURFACE OF A BORE

CROSS-REFERENCE TO RELATED APPLICATIONS

This application claims priority from Japanese Patent Application Serial Nos. 2007-274913, filed Oct. 23, 2007, 2007-274916, filed Oct. 23, 2007, and 2008-172160, filed Jul. 1, 2008, each of which is incorporated herein in its entirety by reference.

TECHNICAL FIELD

The invention relates in general to a method of forming a sprayed film and an apparatus for applying a sprayed film.

BACKGROUND

In order to enhance the performance output, fuel economy and exhaust of gases and/or to aid miniaturization and weight reduction of an internal combustion engine, it is preferred to eliminate cylinder liners used in the cylinder bores of an aluminum cylinder block. As one technique to accomplish this, there has been used a spraying technique for forming a sprayed film made of an iron-based material on an inner surface of the aluminum cylinder bore (see, for example, Japanese Patent Application Laid-open (JP-A) No. 2006-291336).

A sprayed film is applied by rotationally moving a spraying gun in an axial direction of a cylinder bore. In order to prevent foreign matter such as oxide from being caught in the sprayed film, the application may be carried out while providing an airflow inside of the cylinder bore as disclosed in JP-A No. 2006-291336.

BRIEF SUMMARY

A sprayed film forming method and apparatus for forming a sprayed film at an inner surface of a circular bore are taught herein. According to one embodiment of the invention, the method includes moving and rotating a spraying gun in an axial direction inside of the bore, forming the sprayed film by spraying a melted spraying material at the inner surface of the bore using the spraying gun and increasing the spraying amount of spraying material per unit area at a first axial end of the circular bore than that at other portions of the inner surface of the bore.

According to this and other embodiments of the invention described in detail hereinafter, the spraying amount of spraying material at the axial end of the bore, at which the thickness of the sprayed film is liable to become thinner, is increased to more than those at the other portions, thus making uniform the entire sprayed film over the inner surface of the bore. The spraying amount of spraying material is increased only at the axial end of the bore, thus reducing spraying time, finishing time and the amount of spraying material used in a situation where the entire thickness is increased in order to thicken the portion at the axial end that is liable to be thinner.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

In JP-A No. 2006-291336, air is sucked from one end in the axial direction of the cylinder bore by a suction device such as a fan so that an air stream is generated by the air flow inside of the cylinder bore. A flow rate in the vicinity of the end on the suction side tends to become higher than those at other portions under an influence of a shape or the like of the cylinder bore.

Under such circumstances, a thickness of a sprayed film in the vicinity of the end on the side may become smaller than those at the other portions due to the higher air flow rate since the sprayed material is made to flow by the air.

Therefore, the portion having the smaller thickness needs be further thickened in such a manner as to obtain a specified thickness after a finishing process, such as honing, that is performed after the formation of the sprayed film. As a result, the other portions of the film may become thicker than required as the entire thickness is further increased in order to thicken the portion having the smaller thickness. This also causes an increase in spraying time, an increase in finishing time thereafter and an increase in the amount of spraying material used.

In contrast, embodiments of the invention equalize a thickness of the film at an axial end of a circular bore to those at other portions while reducing an increase in working time and amount of a spraying material used.

A detailed description is given below of embodiments according to the invention with reference to the attached drawings.

Figure 1:
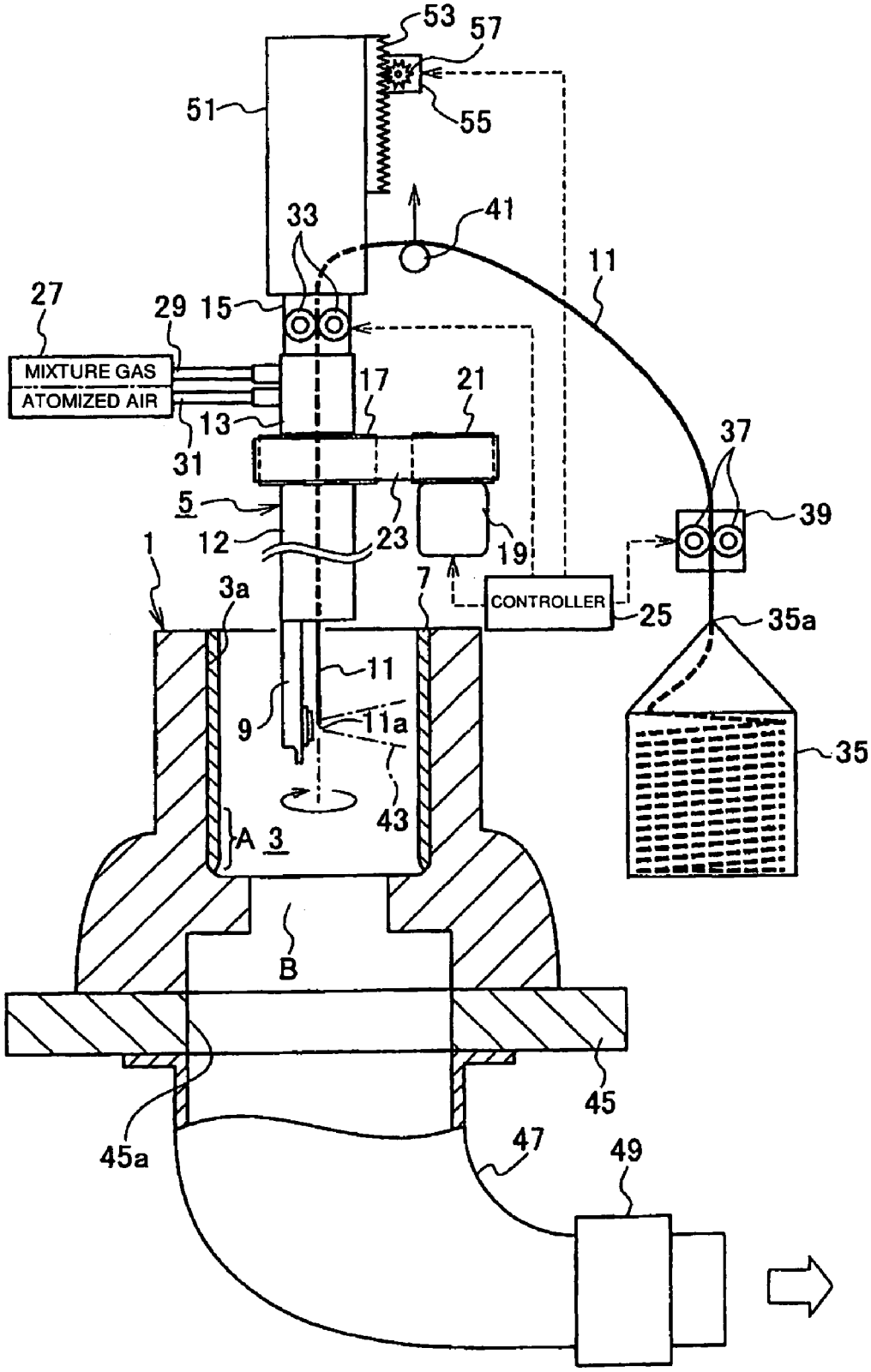
FIG. 1 is a schematic view showing a sprayed film forming apparatus according to a first embodiment of the invention.

FIG. 1 shows a sprayed film 7 formed by using a spraying gun 5 and located at a bore inner surface 3*a* of a cylinder bore 3 in a cylinder block 1 made of an aluminum alloy in an engine. Here, the cylinder bore 3 is a circular bore.

The spraying gun 5 includes a spraying nozzle 9. Inside of the spraying gun 5 is housed a wire 11 serving as a spraying material. Wire 11 is made of an iron-based metal inserted from an upper end of the spraying gun 5 and supplied down to the spraying nozzle 9.

The spraying gun 5 includes a rotary unit 12, a gas pipeline connector 13 and a wire feeder 15 serving as a material supplying device to the spraying nozzle 9. Around the vicinity of the gas pipeline connector 13 in the rotary unit 12 is disposed a driven pulley 17, and a driving pulley 21 is connected to a rotary drive motor 19 serving as a spraying gun operating device. These pulleys 17 and 21 are connected to each other via a connecting belt 23. The rotary drive motor 19 is controllably driven by a controller 25 serving as a spraying gun operation control device, thereby rotating the rotary unit 12 together with the spraying nozzle 9 at the tip thereof. Controller 25 is implemented in, for example, a conventional statistical process controller such as is known in the art. Controller 25 is thus a microcomputer including a random access memory (RAM), a read-only memory (ROM) and a central processing unit (CPU), along with various input and output connections. Generally, the control functions described herein and associated with controller 25 are performed by execution by the CPU of one or more software programs stored in ROM. Of course, some or all of the functions can be implemented by hardware components.

The rotary unit 12 and the spraying nozzle 9 are rotated on the wire 11 inside of the spraying gun 5 as a center axis without any rotation of the wire 11.

A rack 53 vertically extends at a side of a gun base 51 disposed at an upper portion of the wire feeder 15. To the rack 53 is connected a pinion 57 rotated by a vertical drive motor 55 serving as the spraying gun operating device for moving the spraying gun 5 in an axial direction. In other words, the drive of the vertical drive motor 55 vertically moves the spraying gun 5 together with the gun base 51. The vertical drive motor 55 is controllably driven by the controller 25.

Incidentally, the gun base 51 and the rotary drive motor 19 are supported by support frames, not shown, respectively, on a side of an apparatus body in a vertically movable manner. Further, the vertical drive motor 55 is secured to the apparatus body.

When the spraying gun 5 is vertically moved, a guide roller 41 is appropriately moved up or down to controllably prevent any trouble occurring in supplying the wire 11.

To the gas pipeline connector 13 are connected a mixture gas pipeline 29 for supplying mixture gas of hydrogen with argon from a gas supply source 27 and an atomized air pipeline 31 for supplying atomized air (air) from the gas supply source 27. The mixture gas supplied into the gas pipeline connector 13 via the mixture gas pipeline 29 is further supplied down to the spraying nozzle 9 through a mixture gas passage, not shown, formed inside of the rotary unit 12 disposed thereunder. In the same manner, the atomized air supplied into the gas pipeline connector 13 via the atomized air pipeline 31 is further supplied down to the spraying nozzle 9 through an atomized air passage, not shown, formed inside of the rotary unit 12 disposed thereunder.

Here, the mixture gas passage and the atomized air passage, neither shown, inside of the gas pipeline connector 13 need to communicate with the mixture gas passage and the atomized air passage inside of the rotary unit 12, which is rotatable relative to the gas pipeline connector 13. A communication structure in this case is such designed that, for example, a lower end of each of the mixture gas passage and the atomized air passage inside of the gas pipeline connector 13 serves as an annular passage, with which an upper end of each of the vertically extending mixture gas passage and atomized air passage inside of the rotary unit 12 communicates. In this manner, even if the rotary unit 12 is rotated relative to the gas pipeline connector 13, the mixture gas passage and the atomized air passage inside of the gas pipeline connector 13 communicate all the time with the mixture gas passage and the atomized air passage inside of the rotary unit 12.

The wire feeder 15 is provided with a pair of feed rollers 33 that are rotated upon receipt of an input of a specified engine speed signal from the controller 25 to sequentially feed the wire 11 toward the spraying nozzle 9. Moreover, the wire 11 is housed inside of a wire housing container 35. The wire 11 drawn through an outlet 35*a* formed at an upper portion of the wire housing container 35 is fed toward the spraying gun 5 via the guide roller 41 by a wire feeder 39 provided with a pair of feed rollers 37 that is located on the container side and serves as a material supplying device.

The wire feeder 39 on the container side and the wire feeder 15 are controllably driven by the controller 25. In other words, the controller 25 includes a material supply amount adjusting device for controlling the engine speeds of the feed rollers 33 and 37 by driving devices such as motors so as to adjust a supply speed of the wire 11.

The spraying nozzle 9 includes therein a cathode electrode, thereby applying a voltage between the cathode electrode and a tip 11*a* of the wire 11 serving as an anode electrode. The spraying nozzle 9 discharges the mixture gas supplied to the spraying gun 5 from the gas supply source 27 through a mixture gas outlet so as to generate and ignite an arc whose heat melts the tip 11*a* of the wire 11.

In this case, the wire 11 is sequentially fed forward by driving the wire feeder 39 on the container side and the wire feeder 15 as the wire 11 is melted. At the same time, the atomized air supplied to the spraying gun 7 from the gas supply source 27 is discharged toward the vicinity of the tip 11*a* of the wire 11 through an opening formed in the vicinity of the mixture gas outlet. Then, a melt of the wire 11, that is, a molten material, is adhesively moved forward in the form of a mist 43, thereby forming the sprayed film 7 at the bore inner surface 3*a* of the cylinder bore 3.

Moreover, the wire 11 is movably inserted into a cylindrical upper wire guide, although not shown, disposed at a lower end of the rotary unit 12.

In the sprayed film forming apparatus configured as described above, the spraying gun 5 is inserted into the cylinder bore 3, and is then rotationally moved in the direction of the center axis of the cylinder bore 3 (in the axial direction), so that the mist 43 is sprayed toward the bore inner surface 3*a* to form the sprayed film 7. At this time, the spraying gun 5 makes reciprocating motions, for example, about 5 times in the axial direction in a region substantially across the entire length of the cylinder bore 3, so as to achieve a predetermined thickness of the sprayed film 7. The number of the reciprocating motions is not limited to five, and further, the spraying gun 5 may not make the reciprocating motions but may make a unidirectional motion once.

The cylinder block 1 is securely mounted on a support mount 45 having a through hole 45*a* communicating with the cylinder bore 3. A suction device 49 (corresponding to an air supplying device) provided with a fan is disposed on the way of a duct 47 connected to a lower portion of the support mount 45. During formation of the sprayed film, the suction device 49 is operated so that the air is allowed to flow inside of the cylinder bore 3, thus preventing foreign matters such as oxide from being caught into the sprayed film 7.

In the present embodiment, the air flowing inside of the cylinder bore 3 flows at a higher flow rate at an axially-extending region A (having an axial length of about 20 mm) equivalent to the axial end of the cylinder bore 3 on the suction side as compared with that at other portions (other regions) inside of the cylinder bore 3 since a portion B having a smaller passage area is formed at a lower portion of the region A. A spraying amount of spraying material by the spraying gun 5 to the bore inner surface 3*a* per unit area (per unit length) in the axially predetermined region A is more than those amounts at the other portions.

Specifically, if $\gamma$ (in cm/min, for example) is assumed to represent a supply (feed) speed of the wire 11 to the spraying gun 5 at the other portions, the supply (feed) speed in the predetermined region A is as high as about $\gamma \times 1.5$.

That is to say, when the spraying gun 5 makes reciprocating motions the appropriate number of times to thus form the sprayed film 7 while the spraying gun 5 is rotated at the center position of the cylinder bore 3, the feed amount (the supply amount) of wire 11 is increased by increasing the engine speeds of the feed rollers 33 and 37 in the wire feeders 15 and 39, respectively, when the tip of the spraying nozzle 9 is located at, for example, a position corresponding to the region A at the lower end of the cylinder bore 3.

Figure 2:
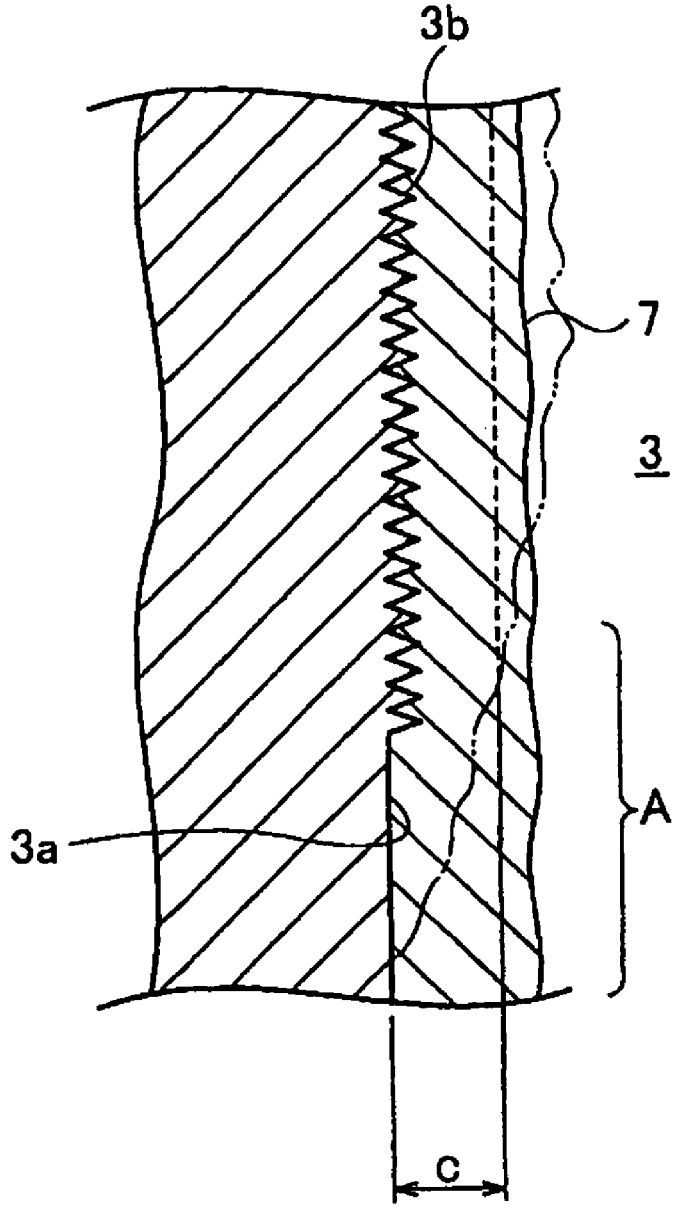
FIG. 2 is an enlarged, cross-sectional view showing a peripheral portion of a sprayed film.

As a consequence, the thickness of the sprayed film 7 in the predetermined region A at the lower end, at which the air flow rate is higher than those at the other portions inside of the cylinder bore 3, can be prevented from being smaller than those at the other portions. FIG. 2 shows an enlarged, peripheral portion of the sprayed film 7 formed as described above. It is found that the thickness in the region A is substantially equal to those at the other portions, and therefore, the entire thickness becomes uniform.

In contrast, where the spraying amount of spraying material by the spraying gun 5 in the region A is not increased, but is instead equal to those at the other portions, the thickness in the region A is smaller than those at the other portions as indicated by a chain double-dashed line in FIG. 2. If the number of reciprocating motions of the spraying gun 5 across the entire length of the cylinder bore 3 is increased so as to further thicken the thin region, the thickness at the other portions above the region A becomes larger than required, thereby increasing the amount of spraying material used and prolonging spraying time.

After the formation of the sprayed film, the surface of the sprayed film 7 is finished in such a manner as to achieve a specified thickness C as indicated by a broken line in FIG. 2. Such finishing is generally performed by a honing device, for example.

In FIG. 2, before the formation of the sprayed film 7, the bore inner surface 3*a* can be roughened by forming an unevenness 3*b*, thereby enhancing the adhesiveness of the sprayed film 7.

In the present embodiment, the entire thickness of the sprayed film 7 can be made substantially uniform. Therefore, a margin to the specified thickness C can be as small as possible in finishing, thus shortening the finishing time and reducing the amount of spraying material used as a whole.

Additionally, in the present embodiment, the spraying amount of spraying material is increased only in the region A, thus suppressing an increase in spraying time in the case where the entire thickness inclusive of the thickness of the region A is increased so as to increase the thickness in the region A, which is liable to be smaller under normal circumstances.

In the present embodiment, the spraying amount is increased by increasing the supply (feed) speed of the wire 11 to the spraying gun 5 in the region A in comparison with the speed at the other portions. Since the movement speed of the spraying gun 5 is constant, the spraying time is not increased.

In a second embodiment according to the invention, a sprayed film 7 is formed at the movement speed of a spraying gun 5 in a region A lower than those at other portions, although the supply speed of the wire 11 in the predetermined region A is increased in the first embodiment. In other words, a time per unit length in a movement direction of the spraying gun 5 staying in the predetermined region A is longer than those at the other portions.

For example, if β, in mm/min, is assumed to represent an axial speed of the spraying gun 5 at the other portions, an axial movement speed in the predetermined region A becomes a maximum of β×0.9 mm/min.

In the lower movement speed of the spraying gun 5, only the axial movement speed may be reduced (a rotary movement speed is constant), only the rotary movement speed may be reduced (the axial movement speed is constant), or both the axial movement speed and the rotary movement speed may be reduced.

As described above, when the movement speed of the spraying gun 5 in the predetermined region A is made lower than those at the other portions, the spraying gun 5 in the predetermined region A sprays a spraying material onto a bore inner surface 3*a* in more spraying amount per unit area (length) than those at the other portions. This suppresses a decrease in thickness of the sprayed film 7 more than the decreases at the other portions in the predetermined region A.

As a consequence, like in the first embodiment, the thickness of the sprayed film 7 in the predetermined region A becomes substantially equal to those thicknesses at the other portions, so that the entire thickness becomes uniform, as shown in FIG. 2, thus producing the same effects as those in the first embodiment.

In a third embodiment according to the invention, the movement of a spraying gun 5 is stopped once in predetermined region A although the supply speed of the wire 11 in the predetermined region A is increased in the first embodiment. Also in the third embodiment, a time per unit length in a movement direction of the spraying gun 5 staying in the predetermined region A is longer than those at the other portions, like in the second embodiment.

While the movement of the spraying gun 9 is temporarily stopped, a rotational movement of the spraying gun 5 is continued, whereas an axial movement is temporarily stopped on the way of the rotational movement. After the temporary stoppage, the axial movement is started again. The temporary stoppage and the restart are repeated.

In this manner, a thickness of a sprayed film 7 in a predetermined region A can be suppressed from being reduced in comparison with those thicknesses at other portions.

As a consequence, like in the first and second embodiments, the thickness of the sprayed film 7 in the predetermined region A becomes equal to those thicknesses at the other portions, so that the entire thickness becomes uniform, as shown in FIG. 2, thus producing the same effects as those in the first and second embodiments.

Incidentally, the spraying operations in the predetermined region A in the cylinder bore 3 in the above-described first, second and third embodiments may be performed singly or in appropriate combinations. For example, the operation for increasing the supply speed of the wire 11 serving as the spraying material (in the first embodiment) and the operation for decreasing the movement speed of the spraying gun 5 (in the second embodiment) may be performed at the same time in the predetermined region A.

Next, a description is given of a fourth embodiment according to the invention. In the fourth embodiment, the number axial movements of a spraying gun 5 in a predetermined region A at an axial end of the cylinder bore 3 is made more than the number of such movements at other portions.

Specifically, the spraying gun 5 makes reciprocating motions, for example, five times in a region across the entire axial length of the cylinder bore 3, as described above. During one reciprocating motion, the spraying gun 5 makes the reciprocating motions a further three times in the predetermined region A. As a consequence, when the spraying gun 5 makes the reciprocating motions five times across the entire axial length of the cylinder bore 3, the spraying gun 5 makes the reciprocating motions fifteen (15) times in the predetermined region A.

Figure 3:
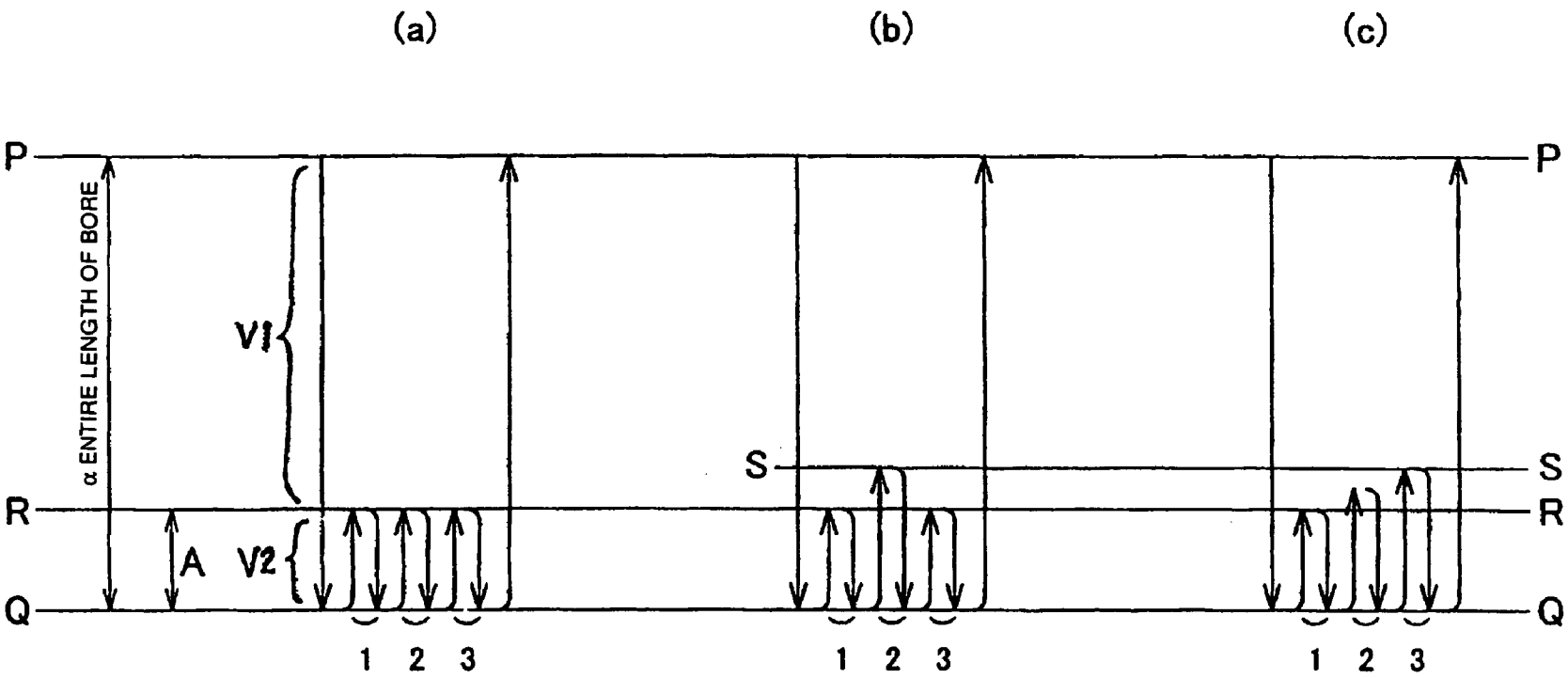
FIG. 3 is a diagram illustrating operations of an axial movement mode when a spraying gun is moved forward and backward once across the entire axial length of a cylinder bore wherein (a) is a first example, (b) is a second example and (c) is a third example.

In FIG. 3, (a) is a diagram illustrating a movement mode when the spraying gun 5 is moved forward and backward once across the entire axial length α of the cylinder bore 3.

That is, the spraying gun 5 makes the reciprocating motion downward in a region from one axial end P inside of the cylinder bore 3 to the other end Q, and then makes the reciprocating motions three times in the predetermined region A.

Here, in the reciprocating motions in the predetermined region A, a motion toward an upper position R is referred to as a forward motion whereas a motion downward from the position R is referred to as a backward motion. After the spraying gun 5 makes the reciprocating motions three times in the predetermined region A, the spraying gun 5 is moved up to the upper end P by making the backward motion upward across the entire length α from the lower end Q.

The movement of the spraying gun 5, as illustrated in (a), is equivalent to one reciprocating motion across the entire axial length α of the cylinder bore 3. This reciprocating motion is repeated five times. Here, the reciprocating motion across the entire length α and the reciprocating motion in the predetermined region A are not limited to five and three times, respectively, and may be once.

In one reciprocating motion across the entire length α, or a last one out of a plurality of reciprocating motions, only a single unidirectional motion from the upper end P to the lower end Q may be made without any backward motion from the lower end Q to the upper end P. Only a single unidirectional motion from the lower end Q to the upper position R may be made also in the predetermined region A at this time.

To sum up, the number axial movements of the spraying gun 5 inside of the cylinder bore 3 in the predetermined region A at the axial end of the cylinder bore 3 is made more than those at the other portions.

Consequently, the spraying amount of mist 43 per unit area with respect to the predetermined region A at the lower end, at which the air flow rate is higher than the rates at the other portions inside of the cylinder bore 3, becomes greater than the amounts at the other portions, thereby avoiding the thickness of the sprayed film 7 in the predetermined region A from being reduced in comparison with the thicknesses at the other portions. As a result, the thickness in the predetermined region A becomes substantially equal to those at the other portions, so the entire thickness can be uniform as shown in FIG. 2.

At this time, the number of motions of the spraying gun 5 is increased only in the predetermined region A at the axial end of the cylinder bore 3, thereby suppressing an increase in spraying time and an increase in spraying material to be used. This also prevents any increase in thickness at the other regions more than necessary so as to suppress an increase in finishing time.

Incidentally, in the case where the number of motions of the spraying gun 5 in the predetermined region A is not increased to more than but is equal to those at the other portions, the thickness in the predetermined region A becomes smaller than those at the other portions as indicated by the chain double-dashed line in FIG. 2. If the number of reciprocating motions is increased in the region across the entire length α so as to further thicken the thin region, the thickness at the other portions above the predetermined region A becomes greater than required, thereby increasing the amount of wire 11 used and prolonging spraying time.

After the formation of the sprayed film, the surface of the sprayed film 7 is finished in such a manner so as to achieve the specified thickness C as indicated by the broken line in FIG. 2. Such finishing can be performed by a honing device, for example.

Consequently, also in the present embodiment, the entire thickness of the sprayed film 7 can be made uniform. Therefore, a margin to the specified thickness C can be as small as possible in finishing, thus shortening the finishing time and reducing the amount of spraying material used as a whole.

Additionally, in the present embodiment, the number of motions of the spraying gun 5 is increased only in the predetermined region A to more than the number at the other portions. This suppresses an increase in spraying time over the situation where the entire thickness including the thickness of the predetermined region A is further increased so as to increase the thickness in the predetermined region A, which is liable to be thinner.

In FIG. 3, (b) illustrates an example of a variation of the reciprocating motion of the spraying gun 5 in the predetermined region A in contrast with (a). In this variation, the spraying gun 5 is moved up to a position S beyond the position R in a second one out of the three reciprocating motions in the predetermined region A, whereas the spraying gun 5 is moved between the position R and the lower end Q in first and third reciprocating motions, like in (a).

The thickness of the sprayed film 7 in the predetermined region A, indicated by the chain double-dashed line in FIG. 2, is generally greatest at the position R corresponding to the upper end in the predetermined region A. The thickness tends to become gradually smaller toward the lower end Q from the position R.

Here, the reciprocating motion of the spraying gun 5 in the predetermined region A illustrated in (a) needs to be carried out in the gradually thinner region since the mist needs to be intensively sprayed in the gradually thinner region in such a manner as not to thicken the region having a satisfactory thickness upward of the predetermined region A.

As a consequence, the shortage of the spraying amount can locally occur at an uppermost end in the predetermined region A where the thickness starts to become smaller, thereby defining a recess thereat. In view of this, the spraying gun 5 is moved up to the position S beyond the position R during the second reciprocating motion in the predetermined region A, as illustrated in (b). Thus, the thickness in the predetermined region A becomes more uniform.

Incidentally, although the spraying gun 5 is moved up to the position S during the second one out of the three reciprocating motions in the predetermined region A in FIG. 3B, it may be moved up to the position S during the third or first reciprocating motion instead of the first reciprocating motion.

Alternatively, the spraying gun 5 may be moved up to the position S during the third reciprocating motion out of the three reciprocating motions in the predetermined region A so that upper stop positions (positions of top dead center) gradually reach the position S during the two reciprocating motions until the third reciprocating motion, as illustrated in (c) of FIG. 3. Although the top dead center during the first reciprocating motion is set at the position R in (c), the top dead center during the second reciprocating motion may also be set at the position R.

As described above, the thickness in the predetermined region A can be made more uniform by making the axial stop positions during the forward motions when the spraying gun 5 makes the plurality of reciprocating motions in the predetermined region A different from each other.

Incidentally, although the axial movement speed and the rotational movement speed of the spraying gun 5 are constant in the above-described fourth embodiment, at least one of the axial movement speed and the rotational movement speed may be higher than those speeds at the other portions when the spraying gun 5 makes the reciprocating motion in or near the predetermined region A, as illustrated in (a) to (c) of FIG. 3.

For example, a movement speed V2 between the positions R and Q is made higher than a movement speed V1 between the positions P and R in (a) to (c). The movement speed V1 may be kept immediately before the spraying gun 5 reaches the position Q from the position P through the position R, and thereafter it may be changed to the movement speed V2 immediately before the spraying gun 5 reaches the position Q.

Otherwise, the movement speed V1 may be set immediately after the movement from the position Q to the position R during the movement to the position P from the position Q through the position R.

As described above, either one or both of the axial movement speed and the rotational movement speed of the spraying gun 5 in the predetermined region A are made higher than those in the other regions, thereby suppressing any occurrence of spraying unevenness of the mist 43 at the bore inner surface 3*a*, so as to obtain the uniform sprayed film 7.

Incidentally, the fourth embodiment may be appropriately combined with each of the first to third embodiments.

Also, the above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A method of forming a sprayed film on an inner surface of a bore, the method comprising:

moving and rotating a spraying gun in an axial direction inside of the bore;

forming the sprayed film by spraying a melted spraying material at the inner surface of the bore by the spraying gun; and increasing a spraying amount of the spraying material per unit area at a first axial end of the inner surface of the bore to more than that at other portions of the inner surface of the bore by reducing a rotational speed of the spraying gun at the first axial end.

2. The method according to claim 1 wherein movement of the spraying gun in the axial direction is stopped at the first axial end of the bore bore for a period of time.

3. The method according to claim 1, further comprising:

flowing a gas toward the first axial end of the bore from a second axial end of the bore located opposite in the axial direction from the first axial end of the bore.

4. A method of forming a sprayed film on an inner surface of a bore, the method comprising:

moving and rotating a spraying gun in an axial direction inside of the bore;

forming the sprayed film by spraying a melted spraying material at the inner surface of the bore by the spraying gun; and increasing a spraying amount of the spraying material per unit area at a first axial end of the inner surface of the bore to more than that at other portions of the inner surface of the bore by increasing a supply speed of the spraying material to the spraying gun at the first axial end of the bore to greater than the supply speed of the spraying material at the other portions of the bore.

5. The method according to claim 4 wherein a rotational speed of the spraying gun is less at the first axial end of the bore than those at the other portions of the bore.

6. A method of forming a sprayed film on an inner surface of a bore, the method comprising:

moving and rotating a spraying gun in an axial direction inside of the bore;

forming the sprayed film by spraying a melted spraying material at the inner surface of the bore by the spraying gun; and increasing a spraying amount of the spraying material per unit area at a first axial end of the inner surface of the bore to more than that at other portions of the inner surface of the bore by performing a reciprocating motion including a forward movement from the first axial end of the bore toward a center of the bore in the axial direction and a backward movement from the center of the bore in the axial direction toward the first axial end of the bore between a first continuous movement of the spraying gun to the first axial end of the bore from an entry end of the bore and a second continuous movement of the spraying gun from the first axial end of the bore to the entry end of the bore, the first and the second continuous movements of the spraying gun performed a plurality of times.

7. The method according to claim 6 wherein a number of movements of the spraying gun in the axial direction inside of the bore at the first axial end is greater than a number of movements at other portions of the bore.

8. The method according to claim 6 wherein the reciprocating motion is performed a plurality of times between the first and the second continuous movements, an axial stop position in the forward movement of each of the plurality of reciprocating motions being the same.

9. The method according to claim 6 wherein the reciprocating motion is performed a plurality of times between the first and the second continuous movements, an axial stop position in the forward movement of each of the plurality of reciprocating motions being different from each other.

10. The method according to claim 6 wherein the reciprocating motion of the spraying gun at the first axial end of the bore is performed at least twice between the first and the second continuous movements, the stop position in a second reciprocating motion being located toward the center of the bore in the axial direction more than that in a first reciprocating motion.

11. A method of forming a sprayed film on an inner surface of a bore, the method comprising:

moving and rotating a spraying gun in an axial direction inside of the bore;

forming the sprayed film by spraying a melted spraying material at the inner surface of the bore by the spraying gun; and increasing a spraying amount of the spraying material per unit area at a first axial end of the inner surface of the bore to more than that at other portions of the inner surface of the bore by stopping the movement of the spraying gun in the axial direction at the first axial end for a period of time.

12. The method according to claim 11, wherein a rotational speed of the spraying gun is less at the first axial end of the bore than those at the other portions of the bore.

* * * * *